US010883697B1

(12) United States Patent
Ma

(10) Patent No.: US 10,883,697 B1
(45) Date of Patent: Jan. 5, 2021

(54) ASSEMBLED LAMP COVER

(71) Applicant: DONGGUAN YOUNAI INDUSTRIAL CO., LTD., Dongguan (CN)

(72) Inventor: Lingfang Ma, Dongguan (CN)

(73) Assignee: DONGGUAN YOUNAI INDUSTRIAL CO., LTD., Dongguan (CN)

( * ) Notice: Subject to any disclaimer, the term of this patent is extended or adjusted under 35 U.S.C. 154(b) by 0 days.

(21) Appl. No.: 16/881,037

(22) Filed: May 22, 2020

(51) Int. Cl.
*F21V 1/06* (2006.01)
*F21V 1/14* (2006.01)

(52) U.S. Cl.
CPC ..... *F21V 1/06* (2013.01); *F21V 1/143* (2013.01)

(58) Field of Classification Search
None
See application file for complete search history.

(56) References Cited

U.S. PATENT DOCUMENTS 10,653,218 B1 * 5/2020 Volin ..... A45B 25/02
2007/0165408 A1 * 7/2007 Li ..... F21V 29/76 362/294

* cited by examiner

*Primary Examiner* — Ashok Patel

(57) ABSTRACT

The present invention discloses an assembled lamp cover comprising: an unfoldable and curable cover body, an annular upper holder, and a lower holder. Due to the fact that the cover body is unfoldable and curable, and the upper holder and the lower holder can be separated into a plurality of smaller parts, the size of the present invention after being separated becomes extremely small, taking up less space, convenient to package, store and carry in the later period; especially, since the unfoldable and curable cover body, even if collision or extrusion occurs in the carrying process, damage cannot be caused, saving transportation cost.

9 Claims, 4 Drawing Sheets

ASSEMBLED LAMP COVER

TECHNICAL FIELD

The present invention relates to the technical field of lamp fitting products, in particular to an assembled lamp cover.

BACKGROUND OF THE PRESENT INVENTION

Several common lamp cover materials are plastic, glass, or canvas. No matter what kind of material is the lamp cover, it needs to be connected to the lamppost or the lamp by means of mechanical assembly through a bolt or connecting block. At present, the lamp cover mostly adopts a fixed structure, that is, the entire lamp cover is an inseparable whole. The lamp cover of this structure has the following deficiencies: 1. because it is not removable, the overall volume is large, requiring a larger casing and taking up more space, not easy to store; and 2. the lamp cover may collide or squeeze during handling or transportation, which may be damaged, seriously affecting the quality, and increasing the transportation cost.

SUMMARY OF THE PRESENT INVENTION

The present invention aims to overcome the defects of the prior art and provides an assembled lamp cover.

In order to solve the technical problem, the present invention adopts the following technical scheme: the assembled lamp cover comprises: an unfoldable and curable cover body, wherein the cover body is provided with connections at both sides, and form an annular body via the fixation by the connections; and the cover body is provided with several first buckles at an upper end, and several second buckles at a lower end; an annular upper holder comprising several first support strips and a first sleeve used for fixing the first support strips together, wherein the first support strips are clamped in position with the first buckles to support the upper end of the cover body; and a lower holder comprising a plastic cement ring, several connecting frames fixed on the periphery of the plastic cement ring through screws and a second sleeve used for fixedly connecting the connecting frames together, wherein the connecting frames are clamped in position with the second buckles to support the lower end of the cover body.

Furthermore, in the above technical scheme, each connecting frame comprises a second support strip bent into an arc shape, a connecting rod integrally formed in the middle of the second support strip and a connecting tab fixed to a tail end of the connecting rod, wherein the connecting tab is fixed with the plastic cement ring through the screw; and the second support strip is clamped in position with the second buckle.

The connecting rod comprises a first horizontal section, an inclined section and a second horizontal section which are integrally connected, wherein an end of the first horizontal section is integrally connected with the middle of the second support strip, and a tail end of the second horizontal section is integrally connected with the connecting tab, so that the connecting tab is protruded relative to the upper end of the second support strip.

Several mounting grooves matched with the connecting tabs in shape are formed in the plastic cement ring, and two positioning bosses are formed in the mounting grooves; the connecting tab is provided with a screw hole through which the screw passes and positioning holes on two sides of the screw hole, and the positioning bosses are clamped and fixed with the positioning holes.

The connection is a magic tape.

The connection is a snap fastener.

The first support strip and the connecting frame are made of metal.

The cover body comprises light-transmitting plastic and linen or canvas which are integrally covered and fixed on the periphery of the light-transmitting plastic.

The first sleeve and the second sleeve are identical in structure and size.

After the technical scheme is adopted, the present invention has the following beneficial effects compared with the prior art: The present invention comprises three parts, i.e. the cover body, the upper holder and the lower holder, which are mutually assembled and fixed to form a complete lamp cover, wherein the cover body is unfoldable and curable, and the upper holder and the lower holder can be separated into a plurality of smaller parts, the size of the present invention after being separated becomes extremely small, taking up less space, convenient to package, store and carry in the later period; especially, since the unfoldable and curable cover body, even if collision or extrusion occurs in the carrying process, damage cannot be caused, and transportation cost is saved. In addition, the present invention is simple in structure and convenient to plug and assemble, endowing the present invention with strong market competitiveness.

DETAILED DESCRIPTION OF THE PRESENT INVENTION

The present invention is further described below with reference to specific examples and drawings.

Figure 1:
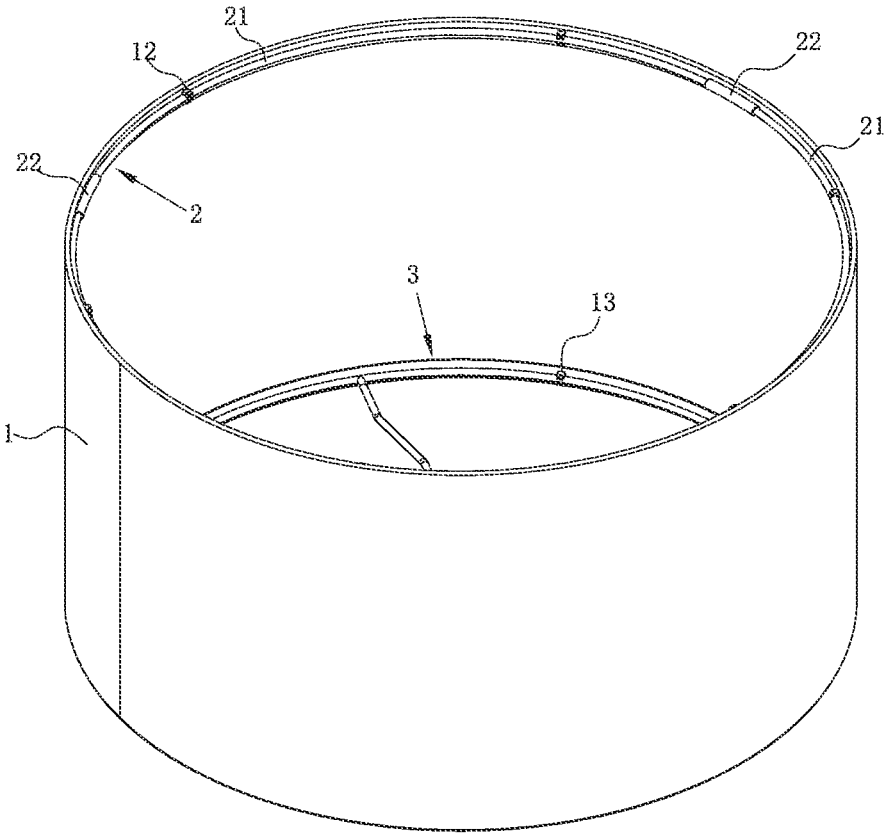
FIG. 1 is a perspective view of an assembled lamp cover of the present invention.
Figure 2:
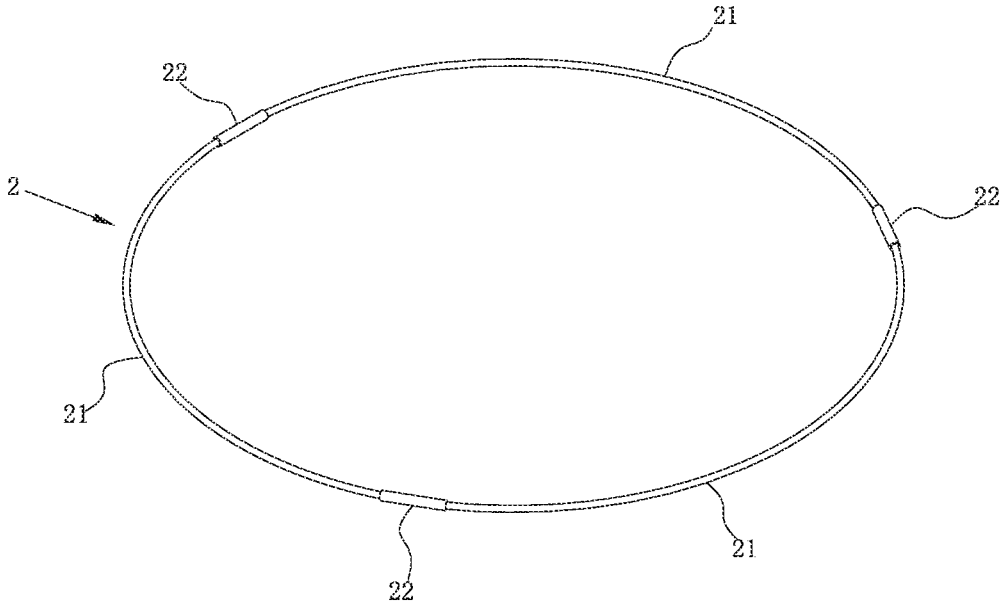
FIG. 2 is a perspective view of an upper holder of the present invention.
Figure 3:
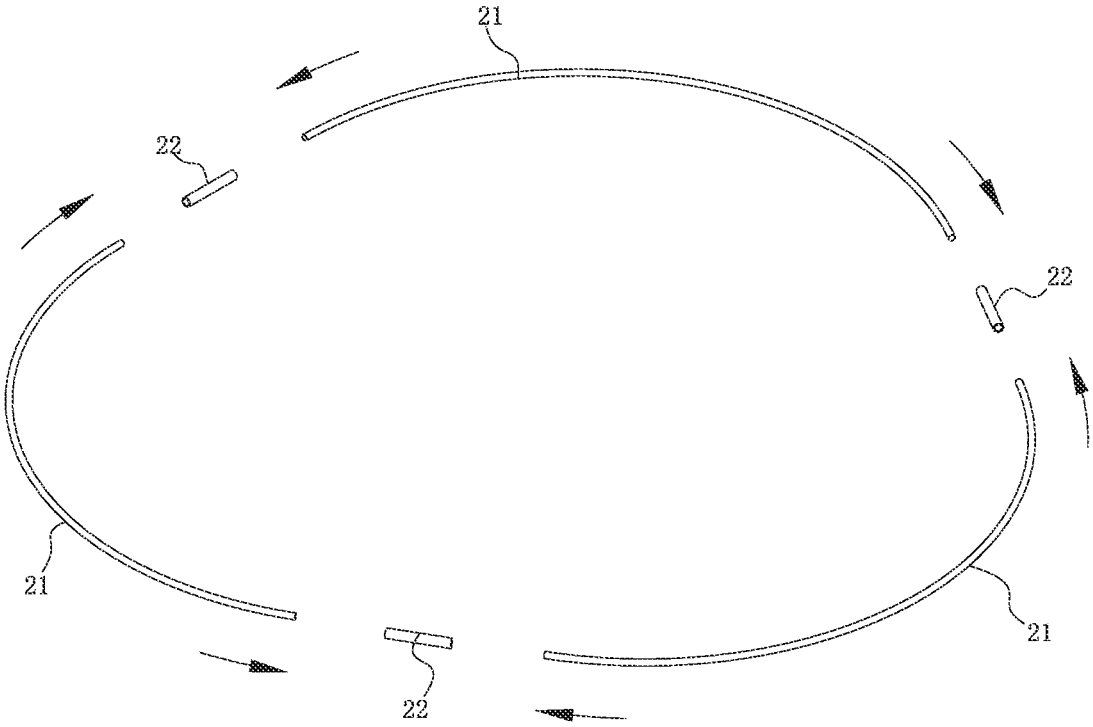
FIG. 3 is an exploded view of the upper holder of the present invention.
Figure 4:
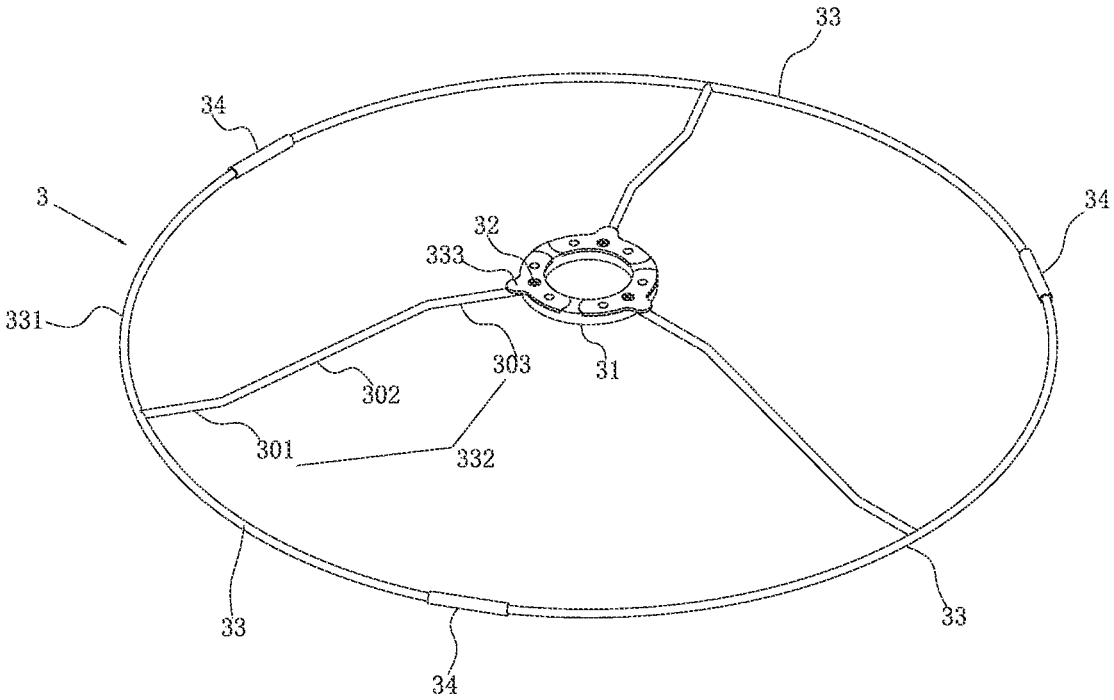
FIG. 4 is a perspective view of a lower holder of the present invention.
Figure 5:
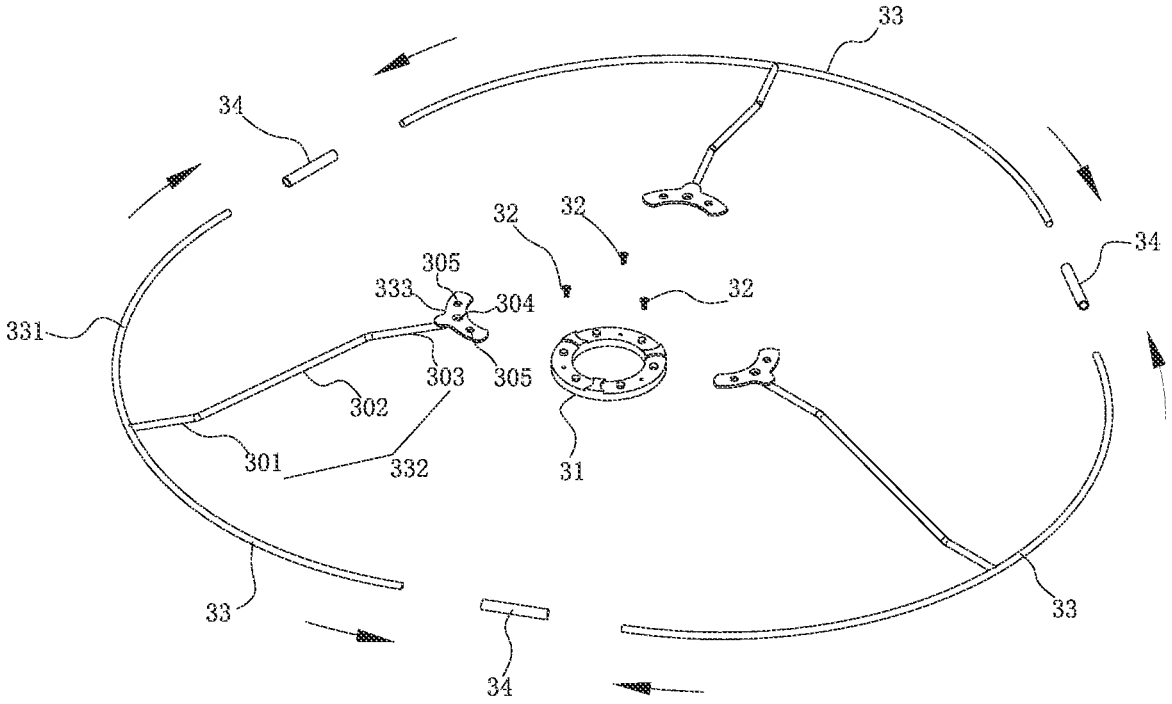
FIG. 5 is an exploded view of the lower holder of the present invention.
Figure 6:
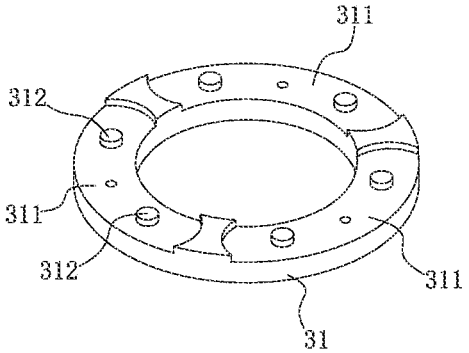
FIG. 6 is a perspective view of a plastic cement ring of the present invention.
Figure 7:
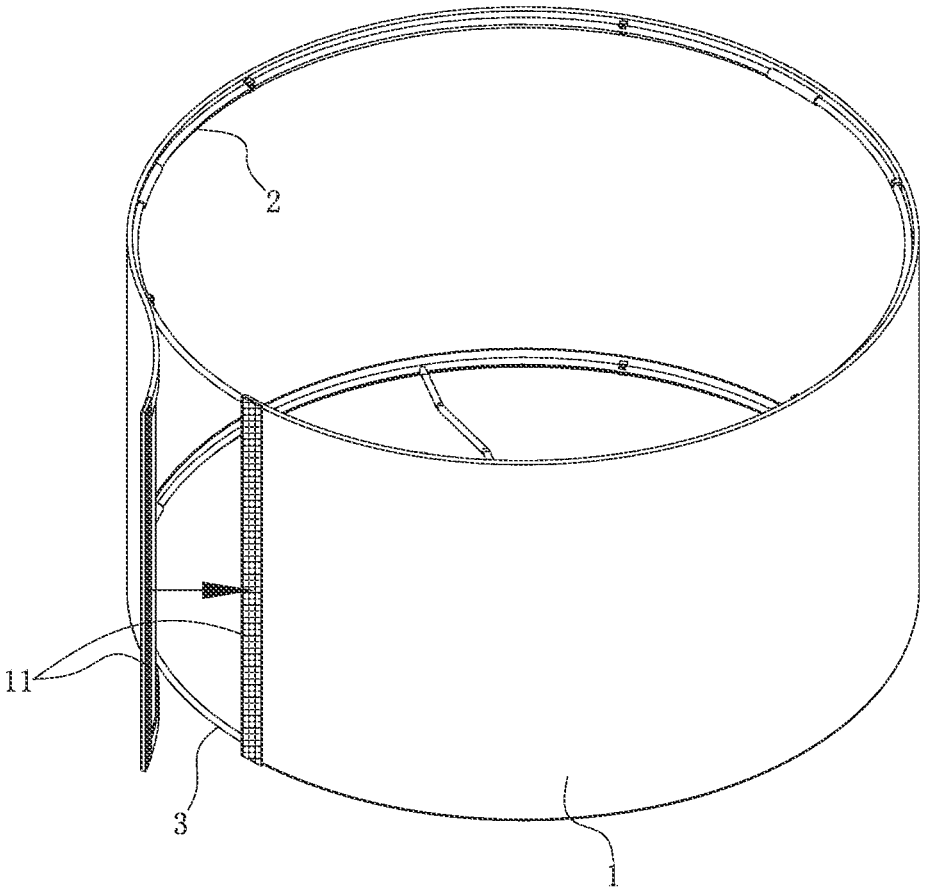
FIG. 7 is an assembly view of the present invention.

Referring to FIGS. 1-7, an assembled lamp cover comprises: an unfoldable and curable cover body 1, wherein the cover body 1 is provided with connections 11 at both sides, and form an annular body via the fixation by the connections 11; and the cover body 1 is provided with several first buckles 12 at an upper end, and several second buckles 13 at a lower end; an annular upper holder 2 comprising several first support strips 21 and a first sleeve 22 used for fixing the first support strips 21 together, wherein the first support strips 21 are clamped in position with the first buckles 12 to support the upper end of the cover body 1; and a lower holder 3 comprising a plastic cement ring 31, several connecting frames 33 fixed on the periphery of the plastic cement ring 31 through screws 32 and a second sleeve 34 used for fixedly connecting the connecting frames 33 together, wherein the connecting frames 33 are clamped in position with the second buckles 13 to support the lower end of the cover body 1. The present invention comprises three parts, i.e. a cover body 1, an upper holder 2 and a lower holder 3, which are mutually assembled and fixed to form a complete lamp cover, wherein the cover body 1 is unfoldable and curable, and the upper holder 2 and the lower holder 3 can be separated into a plurality of smaller parts, the size of the present invention after being separated becomes extremely small, taking up less space, convenient to package, store and carry in the later period; especially, since the unfoldable and curable cover body 1, even if collision or extrusion occurs in the carrying process, damage cannot be caused, and transportation cost is saved. In addition, the present invention is simple in structure and convenient to plug and assemble, endowing the present invention with strong market competitiveness.

Each connecting frame 33 comprises a second support strip 331 bent into an arc shape, a connecting rod 332 integrally formed in the middle of the second support strip 331 and a connecting tab 333 fixed to a tail end of the connecting rod 332, wherein the connecting tab 333 is fixed with the plastic cement ring 31 through the screw 32, the second support strip 331 is clamped in position with the second buckle 13. The connecting frame 33 is simple in structure, high and stable in strength, and the number of the connecting frames 33 is three. The connecting rod 332 comprises a first horizontal section 301, an inclined section 302 and a second horizontal section 303 which are integrally connected, wherein an end of the first horizontal section 301 is integrally connected with the middle of the second support strip 331, and a tail end of the second horizontal section 303 is integrally connected with the connecting tab 333, so that the connecting tab 333 is protruded relative to the upper end of the second support strip 331, that is, the plastic cement ring is protruded relative to the connecting frame 33 so as to facilitate lamp frame installation.

Several mounting grooves 311 matched with the connecting tab 333 in shape are formed in the plastic cement ring 31, and two positioning bosses 312 are formed in the mounting grooves 311; the connecting tab 333 is provided with a screw hole 304 through which the screw 32 passes and positioning holes 305 at two sides of the screw hole 304, and the positioning bosses 312 are clamped and fixed with the positioning holes 305, thereby guaranteeing the stable assembly of the plastic cement ring 31 and the connecting frame 33, and the firmness of an assembly structure.

The connection 11 is a magic tape, so that the cover body 1 can be quickly assembled to form an annular body. Alternatively, the connection 11 is a snap fastener, which also enables the cover body 1 to be quickly assembled to form an annular body.

The first support strip 21 and the connecting frame 33 are both made of metal, strong and firm.

The cover body 1 comprises light-transmitting plastic and linen or canvas which are integrally covered and fixed on the periphery of the light-transmitting plastic, and is firmer in structure and attractive in appearance.

The first sleeve 22 and the second sleeve 34 are identical in structure and size, can be shared, reducing manufacturing cost and improving market competitiveness.

In summary, the present invention comprises three parts, i.e. a cover body 1, an upper holder 2 and a lower holder 3, which are mutually assembled and fixed to form a complete lamp cover, wherein the cover body 1 is unfoldable and curable, and the upper holder 2 and the lower holder 3 can be disassembled into a plurality of smaller parts, the size of the present invention after being separated becomes extremely small, taking up less space, convenient to package, store and carry in the later period; especially, since the unfoldable and curable cover body 1, even if collision or extrusion occurs in the carrying process, damage cannot be caused, and transportation cost is saved. In addition, the present invention is simple in structure and convenient to plug and assemble, endowing the present invention with strong market competitiveness.

Of course, the above description is only specific examples of the present invention, and is not intended to limit the scope of implementation of the present invention, and all equivalent variations or modifications of the structure, features and principles described in the claims should be included in the claims.

The invention claimed is:

1. An assembled lamp cover comprising:

an unfoldable and curable cover body, wherein the cover body is provided with connections at both sides, and form an annular body via the fixation by the connections; a plurality of first buckles are arranged at the upper end of the cover body, and a plurality of second buckles are arranged at the lower end of the cover body;

an annular upper holder comprising several first support strips and a first sleeve used for fixing the first support strips together, wherein the first support strips are clamped in position with the first buckles to support the upper end of the cover body; and a lower holder comprising a plastic cement ring, several connecting frames fixed on the periphery of the plastic cement ring through screws and a second sleeve used for fixedly connecting the connecting frames together, wherein the connecting frames are clamped in position with the second buckles to support the lower end of the cover body.

2. The assembled lamp cover according to claim 1, wherein: each connecting frame comprises a second support strip bent into an arc shape, a connecting rod integrally formed in the middle of the second support strip and a connecting tab fixed to a tail end of the connecting rod, wherein the connecting tab is fixed with the plastic cement ring through the screw; and the second support strip is clamped in position with the second buckle.

3. The assembled lamp cover according to claim 2, wherein: the connecting rod comprises a first horizontal section, an inclined section and a second horizontal section which are integrally connected, wherein an end of the first horizontal section is integrally connected with the middle of the second support strip, and a tail end of the second horizontal section is integrally connected with the connecting tab, so that the connecting tab is protruded relative to the upper end of the second support strip.

4. The assembled lamp cover according to claim 2, wherein: several mounting grooves matched with the connecting tabs in shape are formed in the plastic cement ring, and two positioning bosses are formed in the mounting grooves; the connecting tab is provided with a screw hole through which the screw passes and positioning holes on two sides of the screw hole, and the positioning bosses are clamped and fixed with the positioning holes.

5. The assembled lamp cover according to claim 1, wherein: the connection is a magic tape.

6. The assembled lamp cover according to claim 1, wherein: the connection is a snap fastener.

7. The assembled lamp cover according to claim 1, wherein: the first support strip and the connecting frame are both made of metal.

8. The assembled lamp cover according to claim 1, wherein: the cover body comprises light-transmitting plastic and linen or canvas which are integrally covered and fixed on the periphery of the light-transmitting plastic.

9. The assembled lamp cover according to claim 1, wherein: the first sleeve and the second sleeve are identical in structure and size.

* * * * *